US008955959B2

(12) United States Patent
Teshigawara et al.

(10) Patent No.: US 8,955,959 B2
(45) Date of Patent: Feb. 17, 2015

(54) PRINT APPARATUS

(75) Inventors: Minoru Teshigawara, Saitama (JP); Shigeyasu Nagoshi, Yokohama (JP); Yoshiaki Murayama, Tokyo (JP); Susumu Hirosawa, Tokyo (JP); Takeshi Murase, Yokohama (JP); Yutaka Kano, Yokohama (JP); Satoshi Azuma, Kawasaki (JP); Kentarou Muro, Tokyo (JP); Masao Kato, Kawasaki (JP); Minako Kato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 87 days.

(21) Appl. No.: 12/957,317

(22) Filed: Nov. 30, 2010

(65) Prior Publication Data

US 2011/0211008 A1 Sep. 1, 2011

(30) Foreign Application Priority Data

Feb. 26, 2010 (JP) ..... 2010-042338

(51) Int. Cl.

| | |
|---|---|
| ***B41J 2/01*** | (2006.01) |
| ***B41J 3/60*** | (2006.01) |
| ***B41J 11/66*** | (2006.01) |
| ***B41J 13/00*** | (2006.01) |
| ***B41J 29/393*** | (2006.01) |

(52) U.S. Cl.

CPC *B41J 3/60* (2013.01); *B41J 11/663* (2013.01); *B41J 13/0045* (2013.01); *B41J 29/393* (2013.01)

USPC ..... 347/104; 347/16

(58) Field of Classification Search

CPC ..... B41J 13/0045

USPC ..... 347/16, 104

See application file for complete search history.

(56) References Cited

U.S. PATENT DOCUMENTS 5,452,959 A * 9/1995 Oka ..... 400/149
6,108,513 A * 8/2000 Landa et al. ..... 399/384

(Continued)

FOREIGN PATENT DOCUMENTS

JP 11249346 A * 9/1999
JP 2002-059565 A 2/2002

(Continued)

OTHER PUBLICATIONS

English machine translation of JP 11-249346.*

*Primary Examiner* — Manish S Shah
*Assistant Examiner* — Jeffrey C Morgan
(74) *Attorney, Agent, or Firm* — Canon USA, Inc., IP Division

(57) ABSTRACT

A first reading unit that reads a pattern or an image formed on a sheet by a print unit for recognizing a print unit state, a second reading unit that reads a cut mark formed on the sheet on a downstream thereof, a cutter that cuts the sheet on a downstream thereof, and a reverse unit that reverses the sheet fed to the print unit again are provided. In duplex printing, the sheet where images are sequentially printed on a first surface is led to the reverse unit, the front and rear faces are reversed, and the sheet is fed to the print unit again. The sheet where images and cut marks are sequentially printed on a second surface is cut by the cutter for each piece and discharged. The sheet is cut on the basis of a reading of the cut mark by the second reading unit.

16 Claims, 10 Drawing Sheets

(56) References Cited

U.S. PATENT DOCUMENTS

| | | | | |
|---|---|---|---|---|
| 6,408,750 | B1 * | 6/2002 | Goto et al. | 101/226 |
| 2006/0185547 | A1 * | 8/2006 | Bernard et al. | 101/484 |
| 2008/0074471 | A1 * | 3/2008 | Sakashita et al. | 347/68 |
| 2008/0159800 | A1 * | 7/2008 | Wada | 400/621 |
| 2009/0189928 | A1 * | 7/2009 | Ino et al. | 347/1 |
| 2010/0238251 | A1 * | 9/2010 | Tsuzawa | 347/104 |

FOREIGN PATENT DOCUMENTS

| | | | |
|---|---|---|---|
| JP | 2004-338322 | A | 12/2004 |
| JP | 2005-305712 | A | 11/2005 |

* cited by examiner

PRINT APPARATUS

BACKGROUND OF THE INVENTION

1. Field of the Invention

The present invention relates to a print apparatus using a continuous sheet.

2. Description of the Related Art

Japanese Patent Laid-Open No. 2005-305712 discloses a print apparatus that sequentially prints a plurality of images on a continuous sheet. This print apparatus is provided with a density sensor (35) that measures an ink density of an image on a downstream of a print head (H), a cut position sensor (41) on a downstream thereof, and a cutter (40). By using the print head, together with the plurality of images, a cutter mark is recorded in a margin area between adjacent images, and the sheet is cut for each image on the basis of a cut mark detection by the cut mark sensor. The finished print product thus cut for each image is generated.

In a field such as a photograph album binding, a single print apparatus desirably prints on both sides of a continuous sheet at a high speed and with a high quality. When a plurality of sheets where the duplex printing is performed are bungled and bound, the sizes of the respective sheets are necessarily matched with each other accurately. However, the apparatus described in Japanese Patent Laid-Open No. 2005-305712 is only supposed to perform a print on one face of the sheet. In view of the above, a problem that can be resolved by the present invention resides in how duplex printing can be performed at a high speed and with a high quality and also the sheet can be cut for each piece at a high positional accuracy to generate finished print products.

Also, in the apparatus described in Japanese Patent Laid-Open No. 2005-305712, when the sheet is cut by the cutter, it is necessary to temporarily stop the sheet conveyance at the cut position. Then, a slight impact accompanied by the stop of the sheet is transmitted to the sheet upstream side, and the sheet is slightly displaced, which may affect the reading accuracy at the density sensor and the print accuracy at the print head. In a case where the margin area is provided between the adjacent images as in Japanese Patent Laid-Open No. 2005-305712, after the cut mark is detected, the margin area is unnecessary. Thus, the margin area is cut off by the cutter. In order to cut off the margin area, as the cut is continuously performed twice at two locations including a front end and a rear end of the margin area, and therefore the sheet is continuously stopped twice. For this reason, the impact is transmitted twice to the sheet upstream side, which affects the reading accuracy of the density sensor or the print accuracy of the print head to some extent. Another problem that can be resolved by the present invention resides in how this influence can be diminished.

Also, in the apparatus described in Japanese Patent Laid-Open No. 2005-305712, when the cut position sensor detects the sheet of the cut mark, the cut position sensor necessarily distinguishes the original image from the cut mark and correctly detects only the cut mark. However, if a pattern similar to the cut mark is accidentally included in the original image, this image is misidentified as the cut mark, and the sheet may be cut at a wrong position. Still another problem that can be resolved by the present invention resides in how such false recognition can be suppressed.

SUMMARY OF THE INVENTION

According to an aspect of the present invention, there is provided an apparatus capable of performing duplex printing, including: a print unit configured to print on a sheet at a print position in a path where the sheet is fed from a sheet feeding unit, in which the sheet is continuous; a first reading unit configured to read at least one of a pattern and an image formed on the sheet by the print unit for inspection, at a first reading position on a downstream of the print position in the path; a second reading unit, provided separately from the first reading unit, configured to read a cut mark formed on the sheet at a second reading position on a downstream of the first reading position in the path; a cutter that cuts the sheet at a position on a downstream of the second reading position in the path; and a reverse unit configured to reverse the sheet which has passed through the cutter, in which, in the duplex printing, the print unit prints a plurality of images on a first surface of the sheet fed from the sheet feeding unit, the sheet printed on the first surface is led to the reverse unit, the reverse unit feeds the reversed sheet to the print unit again, the print unit prints a plurality of images and cut marks on a second surface that is a back of the first surface of the sheet fed from the reverse unit, and the cutter cuts the sheet printed on the second surface based on a reading of the cut mark on the second surface by the second reading unit.

According to another aspect of the present invention, the print is performed at a high speed and with a high quality in the duplex printing and also the sheet is cut for each piece at a high positional accuracy so that it is possible to generate the finished print products.

According to another aspect of the present invention, there is provided an apparatus including: a print unit configured to print on a sheet at a print position in a path where the sheet is fed, in which the sheet is continuous; a first reading unit configured to read at least one of a pattern and an image formed on the sheet by the print unit for inspection, at a first reading position on a downstream of the print position in the path; a second reading unit, provided separately from the first reading unit, configured to read a cut mark formed on the sheet at a second reading position on a downstream of the first reading position in the path; a first cutter that cuts the sheet on a downstream of the second reading position in the path; and a second cutter that cuts the sheet on a downstream of the first cutter, in which a plurality of images are sequentially printed on the sheet along a direction in which the sheet is conveyed, the cut marks are formed in margin areas between adjacent images, and the pattern is formed in at least one of the margin areas, and in which the sheet is cut first by the first cutter at a first cut position set on the sheet based on a reading of the cut mark by the second reading unit, and subsequently the sheet is cut by the second cutter at a second cut position set on the sheet, the first cut position is a position corresponding to an end part on an upstream side of the margin area, the second cut position is a position corresponding to an end part on a downstream side of the margin area.

According to another aspect of the present invention, impact may be transmitted only once to the sheet on the upstream side which is accompanied by the sheet cut performed twice by the cutter, and the influence on the reading accuracy by the first reading unit and the influence on the print accuracy can be mitigated. The present invention can thus provide the print products at very high print quality.

According to another aspect of the present invention, there is provided an apparatus including: a print unit configured to print at a print position in a path where a continuous sheet is fed; a first reading unit configured to read at least one of a pattern and an image formed on the sheet by the print unit for inspection, at a first reading position on a downstream of the print position in the path; a second reading unit, provided separately from the first reading unit, configured to read a cut mark formed on the sheet at a second reading position on a downstream of the first reading position in the path; and a cutter that cuts the sheet on a downstream of a reading position by the second reading unit in the path, in, which a plurality of images are sequentially printed on the sheet along a direction in which the sheet is conveyed, the cut marks are formed in margin areas between adjacent images, and the pattern is formed in at least one of the margin areas, and in which the second reading unit reads the cut mark in a limited detection period in which the margin area where the cut mark is formed is expected to pass through the second reading position, and the cutter cuts the sheet on the basis of a reading of the cut mark by the second reading unit.

According to another aspect of the present invention, a situation is avoided in which the sheet is cut at a wrong position as the cut mark sensor avoids misidentifying the original image as the cut mark.

Further features of the present invention will become apparent from the following description of exemplary embodiments with reference to the attached drawings.

DESCRIPTION OF THE EMBODIMENTS

Hereinafter, a description will be provided of a print apparatus using an inkjet system according to an embodiment. The print apparatus of the present example is a high speed line printer that uses a lengthy continuous sheet (long continuous sheet which is longer than a length of a repetitive print unit in a conveying direction (which is referred to as one page or unit image)) and deals with both a simplex printing and a duplex printing. For example, this is suitable to a field of a large amount of prints in a print laboratory or the like. It is noted that according to the present specification, even when a plurality of small images, characters, and spaces are mixed in an area of one print unit (one page), the components included in the relevant area are collectively referred as one unit image. In other words, the unit image means one print unit (one page) in a case where a plurality of pages are sequentially printed on the continuous sheet. It is noted that this may simply be referred to as image instead of unit image in some cases. A length of the unit image varies in accordance with a size of an image to be printed. For example, for a photograph of L-plate size, the length in a sheet conveying direction is 135 mm, and for A4 size, the length in the sheet conveying direction is 297 mm.

The present invention can widely be applied to print apparatuses such as a printer, a printer multi-function device, a copier, a facsimile apparatus, and a manufacturing apparatus for various devices. A print processing may adopt any system such as the inkjet system, an electrophotography system, a thermal transfer system, a dot impact system, and a liquid development system. Also, the present invention can also be applied to a sheet processing apparatus that performs not only the print processing but also various processings on a roll sheet (such as recording, process, application, irradiation, reading, and inspection).

Figure 1:
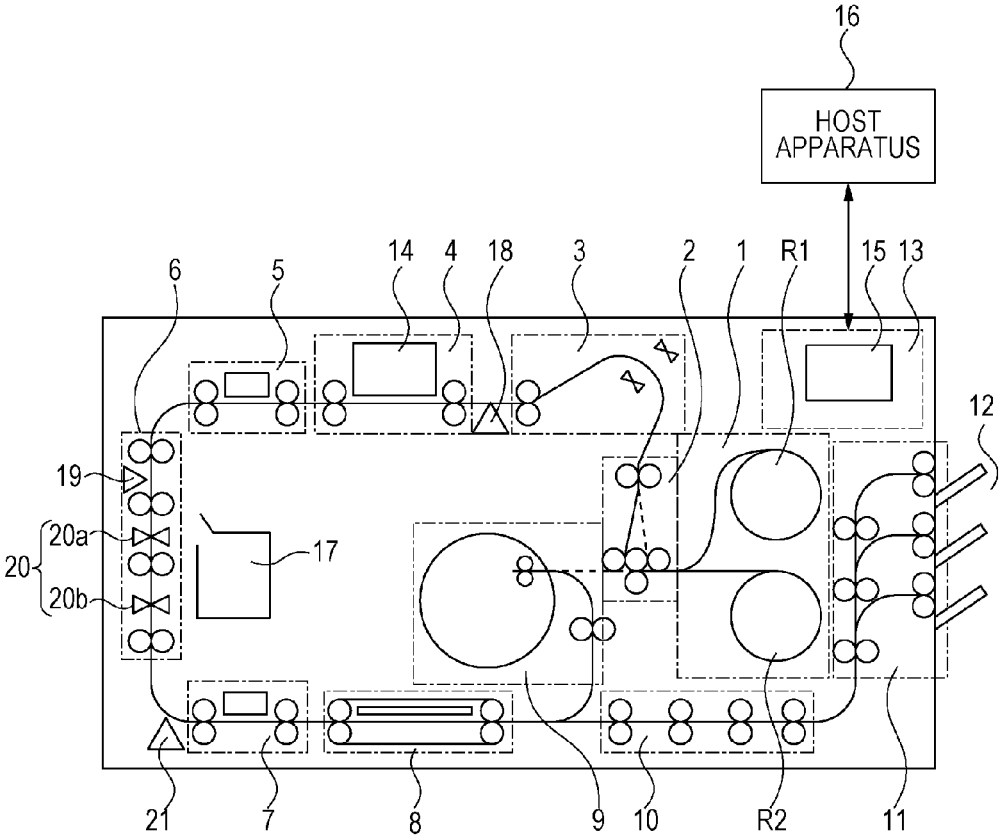
FIG. 1 is a schematic diagram of an internal configuration of a print apparatus.

FIG. 1 is a schematic diagram of a cross section illustrating an internal configuration of the print apparatus. The print apparatus according to the present embodiment can perform the duplex printing on a first surface of the sheet and a second surface on a back side of the first surface by using the sheet wound into a roll. In the print apparatus, roughly, respective units including a sheet feeding unit 1, a decurl unit 2, a skew correction unit 3, a print unit 4, an inspection unit 5, a cutter unit 6, an information recording unit 7, a drying unit 8, a reverse unit 9, a discharge conveyance unit 10, a sorter unit 11, a discharge unit 12, and a control unit 13 are provided. The sheet is conveyed by a conveyance mechanism composed of a roller pair and a belt along a sheet conveyance path represented in the solid line in the drawing and processed in the respective units. The sheet is conveyed downstream along the sheet conveyance path while printing. At an arbitrary position in the sheet conveyance path where the sheet is conveyed from feeding means to discharging means, a side toward the feeding means is referred to as "the upstream side", and the opposite side toward the discharging means is referred to as "the downstream side".

The sheet feeding unit 1 is a unit for holding and feeding the continuous sheet wound into the roll. The sheet feeding unit can accommodate two rolls R1 and R2 and has a configuration of alternatively pulling out the sheet to be fed. It is noted that the number of rolls that can be accommodated is not limited to two, and the sheet feeding unit may accommodate one roll or three or more rolls. Also, as long as the sheet is a continuous sheet, the sheet is not limited to the sheet wound into the roll. For example, the continuous sheet may be provided with a perforation for every unit length and folded for each perforation to be stacked and accommodated in the sheet feeding unit 1.

The decurl unit 2 is a unit that suppresses a curl (warping) of the sheet fed from the sheet feeding unit 1. In the decurl unit 2, by using two pinch rollers for one driving roller, the sheet is bent and allowed to pass so that a warping in a reverse way to the curl is provided, and a decurl force is affected to suppress the curl.

The skew correction unit 3 is a unit that corrects a skew of the sheet passing through the decurl unit 2 (inclination with respect to the original travelling direction). By pressing a sheet end part on a side serving as the reference against a guide member, the skew of the sheet is corrected.

The print unit 4 is a sheet processing unit that performs a print processing on a sheet by a print head 14 with respect to the conveyed sheet to form an image. In other words, the print unit 4 is a processing unit that performs a predetermined processing on the sheet. The print unit 4 is also provided with a plurality of conveying rollers for conveying the sheet. The print head 14 has a line-type print head in which an inkjet system nozzle array is formed in a range covering a maximum width of a sheet expected to be used. In the print head 14, a plurality of print heads are disposed in parallel in the conveying direction. In the present example, seven print heads corresponding to seven colors including C (cyan), M (magenta), Y (yellow), LC (light cyan), LM (light magenta), G (gray), and K (black) are provided. It is noted that the number of colors and the number of print heads are not limited to seven. For the inkjet system, a system using a heater element, a system using a piezoelectric element, a system using an electrostatic element, a system using an MEMS element, or the like can be adopted. Ink of the respective colors is fed from an ink tank via respective ink tubes to the print head 14.

The inspection unit 5 is a unit for optically reading an inspection pattern or an image printed by the print unit 4 on the sheet by using a scanner and inspecting a nozzle state of the print head, a sheet conveyance state, an image position, or the like to determine whether the image is correctly printed. The scanner has a line-type or area-type image sensor capable of reading a range covering the width of the used sheet (a CCD image sensor or a CMOS image sensor). The image sensor is arranged to respond to a plurality of colors used for the inspection pattern, that is, seven ink colors. The inspection unit 5 functions as a first reading unit that read the inspection pattern formed on the sheet on the downstream side with respect to the print position of the print head 14 in the conveyance path.

The cutter unit 6 is a unit having a cutter 20 for cutting the sheet after the print at a predetermined length. The cutter 20 is composed of two mechanical cutters 20*a* and 20*b*. By the cutter 20*a* on the upstream side and the cutter 20*b* on the downstream side, as will be described below, a margin area between the image and the image which are formed on the sheet is efficiently cut off. The cutter unit 6 is further provided with a cut mark sensor 19 that optically detects the cut mark recorded on the sheet and a plurality of conveying rollers for sending out the sheet to the next step. The cut mark sensor 19 has a narrower reading area in the sheet width direction than the image sensor provided to the inspection unit 5. The optical sensor constituting the cut mark sensor 19 is arranged to respond at least to the color used in the cut mark. The cut mark sensor 19 functions as a second reading unit that reads the cut mark formed on the sheet on the downstream side with respect to the reading position by the inspection unit 5 (the first reading unit) in the conveyance path. In the vicinity of the cutter unit 6, a dust bin 17 is provided. The dust bin 17 is designed to accommodate small sheet scraps generated while the margin areas are cut off by the cutters 20*a* and 20*b* and discharged as litter. The cutter unit 6 is provided with a sorting mechanism for deciding whether the cut sheet is discharged into the dust bin 17 or shifted to the original conveyance path.

The information recording unit 7 is a unit that records print information (unique information) such as a serial number for the print or a date in a non-print area of the cut sheet. The recording is carried out by printing a character or a code on the basis of the inkjet system, the thermal transfer system, or the like. On the upstream of the information recording unit 7 and also on the downstream of the cutter unit 6, an edge sensor 21 that detects the leading end edge of the cut sheet is provided. In other words, regarding the edge sensor 21, on the basis of the detection timing for the edge sensor 21 that detects the end part of the sheet between the recording positions by the cutter unit 6 and the information recording unit 7, the timing for the information recording unit 7 to perform the information recording is controlled.

The drying unit 8 is a unit for drying the applied ink in a short period of time by heating the sheet printed by the print unit 4. Inside the drying unit 8, heated air is blown to the passing sheet at least from a lower face to dry the ink applied face. It is noted that the drying system is not limited to the system of blowing the heated air but may also be a system of irradiating the sheet surface with electromagnetic waves (ultraviolet rays, ultrared rays, or the like).

The above-mentioned sheet conveyance path from the sheet feeding unit 1 to the drying unit 8 is referred to as first path. The first path has a U-turn shape between the print unit 4 and the drying unit 8, and the cutter unit 6 is located in the midcourse of the U-turn shape.

The reverse unit 9 is a unit for temporarily rolling up and accommodating the continuous sheet whose front face print is ended when the duplex printing is to be carried out to reverse the front and rear sides. The reverse unit 9 is provided in the midcourse of a path starting from the drying unit 8 via the decurl unit 2 to reach the print unit 4 (loop path) (which will be referred to as second path) for feeding the sheet passing through the drying unit 8 to the print unit 4 again. The reverse unit 9 is provided with a winding rotary member (drum) rotating so as to roll up the sheep. The uncut continuous sheet after the front face print is temporarily rolled up and accommodated by the winding rotary member. When the rolling-up is ended, the winding rotary member inversely rotates, and the wound sheet is sent out in an opposite direction to the rolling-up to be fed to the decurl unit 2 and fed to the print unit 4. The sides of this sheet are reversed, and it is possible to carry out the print on the rear face by the print unit 4. A more specific operation of the duplex printing will be described below.

The discharge conveyance unit 10 is a unit that conveys the sheet cut by the cutter unit 6 and dried by the drying unit 8 to be delivered to the sorter unit 11. The discharge conveyance unit 10 is provided on a path (which will be referred to as third path) which is different from the second path where the reverse unit 9 is provided. In order that the sheet conveyed through the first path is selectively guided to one of the second path and the third path, a path switching mechanism having a movable flapper is provided at a blanching position of the path.

The sorter unit 11 and the discharge unit 12 are provided on a side end of the sheet feeding unit 1 and also on a tail end of the third path. The sorter unit 11 is a unit for sorting the printed sheets when necessary for each group. The sorted sheets are discharged into the discharge unit 12 composed of a plurality of trays. In this manner, the third path has such a layout that the sheet passes below the sheet feeding unit 1 to be discharged on the opposite side to the print unit 4 and the drying unit 8 while sandwiching the sheet feeding unit 1.

As described above, the sheet feeding unit 1 to the drying unit 8 are sequentially provided in the first path. A section after the drying unit 8 is blanched to the second path and the third path. In the midcourse of the second path, the reverse unit 9 is provided, and a section after the reverse unit 9 is merged into the first path. The discharge unit 12 is provided at the tail end of the third path.

The control unit 13 is a unit that governs the control on the respective units of the entire print apparatus. The control unit 13 has a CPU, a storage apparatus, a controller provided with various control units, an external interface, and an operation unit 15 through which a user performs the input and output. An operation of the print apparatus is controlled on the basis of an instruction from a host apparatus 16 such as a controller or a host computer connected via the external interface to the controller.

A mark reader 18 is provided between the skew correction unit 3 and the print unit 4. The mark reader 18 is a reflective optical sensor that optically reads the reference mark recorded on the first surface of the sheet conveyed from the reverse unit 9 from the opposite side to the side where the print is carried out. The mark reader 18 is a light source that illuminates the sheet face (for example, white LED) and a photo diode or the photoreceiver such as an image sensor that detects the light from the illuminated sheet face for each RGB component. The mark can be read on the basis of a change in a signal level of the photoreceiver or an image analysis on image pickup data.

Figure 2:
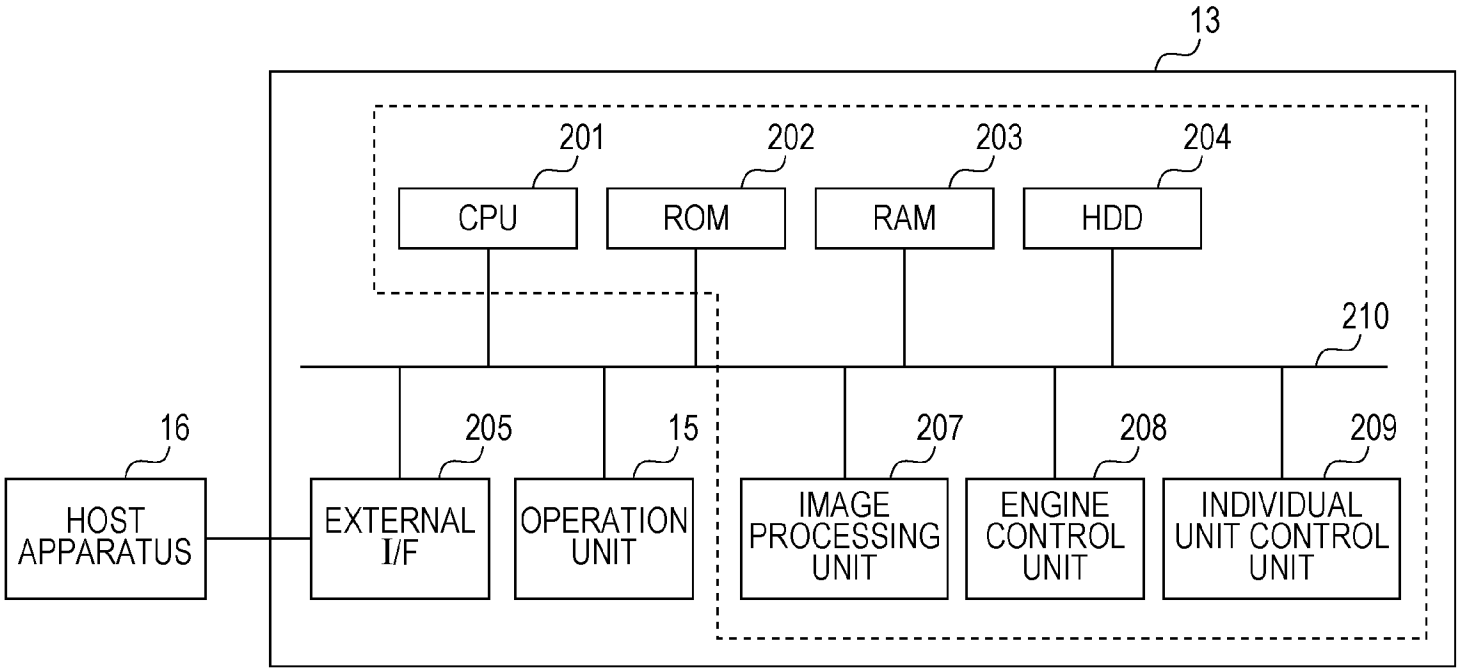
FIG. 2 is a block diagram of a control unit.

FIG. 2 is a block diagram illustrating a concept of the control unit 13. A controller (range surrounded by a broken line) included in the control unit 13 is composed of a CPU 201, a ROM 202, a RAM 203, an HDD 204, an image processing unit 207, an engine control unit 208, and an individual unit control unit 209. The CPU 201 (central processing unit) integrally controls the operations of the respective units in the print apparatus. The ROM 202 stores a program executed by the CPU 201 and fixed data used for various operations of the print apparatus. The RAM 203 is used as a work area for the CPU 201, used as a temporary storage area for various pieces of reception data, and configured to store various pieces of setting data. The HDD 204 (hard disc drive) can store and read the program executed by the CPU 201, print data, and setting information used for various operations of the print apparatus. The operation unit 15 is an input and output interface with the user and includes an input unit such as a hard key or a touch panel and an output unit such as a display for presenting the information or an audio generator.

With regard to a unit for performing high speed data processing, a dedicated-use processing unit is provided. The image processing unit 207 performs an image processing on the print data dealt with by the print apparatus. A color space of the input image data (for example, YCbCr) is converted into a standard RGB color space (for example, sRGB). Also, various image processings such as a resolution conversion, an image analysis, and an image compensation can be applied on the image data. The print data obtained through these image processings is stored in the RAM 203 or the HDD 204. On the basis of a control command received from the CPU 201 or the like, in accordance with the print data, the engine control unit 208 performs a drive control on the print head 14 of the print unit 4. The engine control unit 208 further performs a control of the conveyance mechanism of the respective units in the print apparatus. The individual unit control unit 209 is a sub controller for individually controlling the respective units of the sheet feeding unit 1, the decurl unit 2, the skew correction unit 3, the inspection unit 5, the cutter unit 6, the information recording unit 7, the drying unit 8, the reverse unit 9, the discharge conveyance unit 10, the sorter unit 11, and the discharge unit 12. The operations of the respective units are controlled by the individual unit control unit 209 on the basis of the instruction of the CPU 201. An external interface 205 is an interface (I/F) for connecting the controller to the host apparatus 16, which is a local I/F or a network I/F. The above-mentioned components are connected via a system bus 210.

The host apparatus 16 is an apparatus functioning as a supply source for the image data to be printed by the print apparatus. The host apparatus 16 may be composed of a general-use or dedicated-use computer or also a dedicated-use image device such as an image capture having an image reader, a digital camera, or a photo storage. In a case where the host apparatus 16 is composed of a computer, an OS, application software for generating image data, and a printer driver for the print apparatus are installed in the storage apparatus included in the computer. It is noted that all of the above-mentioned processings may not be realized by the software, and a part or all of the above-mentioned processings may also be realized by hardware.

Next, a description will be provided of a basic operation at the time of the print. The print has different operations in the simplex printing mode and the duplex printing mode, and therefore each of the print modes will be described.

Figure 3A:
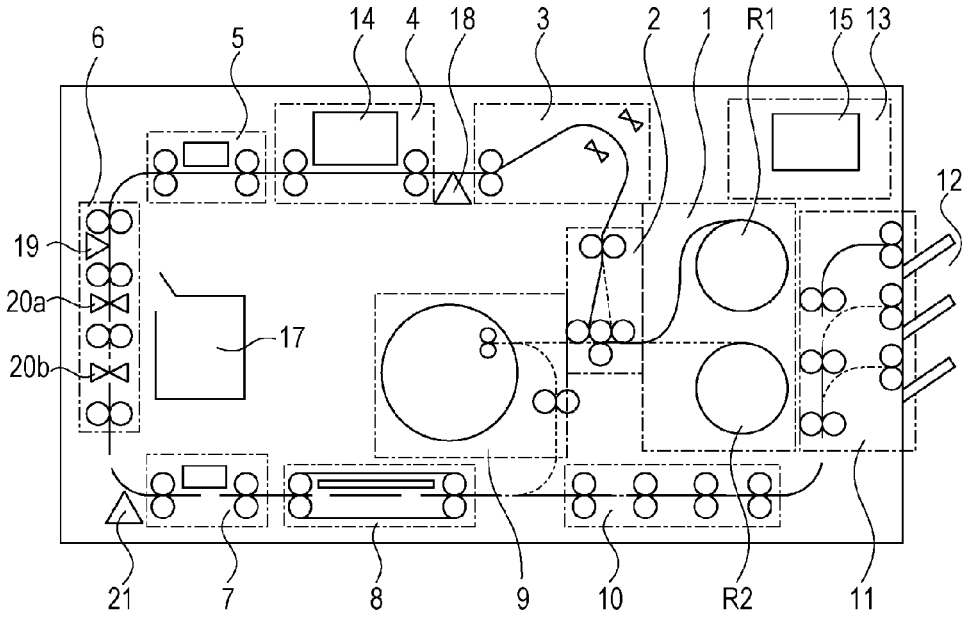
FIGS. 3A and 3B are explanatory diagrams for describing operations in a simplex printing mode and a duplex printing mode.

FIG. 3A is an explanatory diagram for describing the operation in the simplex printing mode. The sheet fed from the sheet feeding unit 1 and processed by the decurl unit 2, the skew correction unit 3 the print unit 4 is subjected to the print on the front face (first surface). On the lengthy continuous sheet, the image having a predetermined unit length in the conveying direction (unit image) is sequentially printed, and a plurality of images are disposed and formed. Herein, a margin area is provided between a certain image and the next image, and a cut mark is recorded in the margin area by the print unit 4. The printed sheet passes through the inspection unit 5 and is cut by the cutter 20 for each unit image on the basis of the detection of the cut mark by the cut mark sensor 19 in the cutter unit 6. On the cut sheet thus cut, when requested the print information is recorded on the rear face of the sheet by the information recording unit 7. Then, the cut sheet is conveyed one by one to the drying unit 8 for performing the drying. After that, the sheet passes through the discharge conveyance unit 10 and is sequentially discharged into the discharge unit 12 of the sorter unit 11 to be stacked. On the other hand, the sheet remaining on the side of the print unit 4 after the cut of the last unit image is fed back to the sheet feeding unit 1, and the sheet is rolled up by the roll R1 or R2.

In this manner, in the simplex printing, the sheet passes through the first path and the third path to be processed but does not pass through the second path. To elaborate, in the simplex printing mode, under the control of the control unit 13, the following sequence of (1) to (6) is executed:

(1) the sheet is fed out from the sheet feeding unit 1 to be fed to the print unit 4;
(2) the print of the unit image and the cut mark on the first surface of the fed sheet is repeatedly performed by the print unit 4;
(3) the cut of the sheet is repeatedly performed by the cutter unit 6 for each unit image printed on the first surface;
(4) the cut sheet is caused to pass through the drying unit 8 one by one for each unit image;
(5) the sheet passing through the drying unit 8 one by one is caused to pass through the third path to be discharged into the discharge unit 12; and
(6) the last unit image is cut, and the sheet remaining on the side of the print unit 4 is fed beck to the sheet feeding unit 1.

Figure 3B:
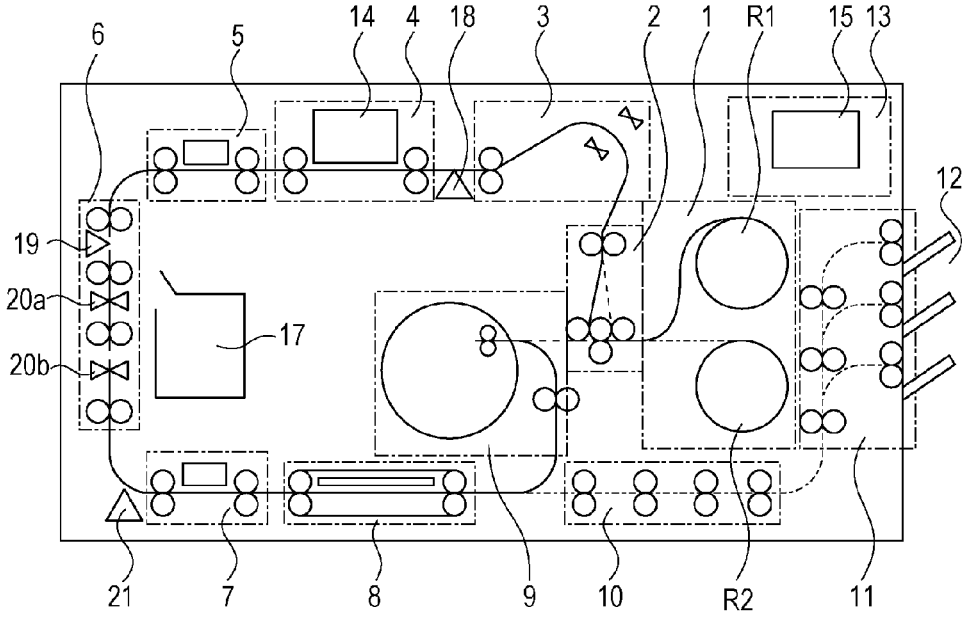

FIG. 3B is an explanatory diagram for describing the operation in the duplex printing mode. In the duplex printing, following the front face (the first surface) print sequence, the rear face (the second surface) print sequence is executed. In the first front face print sequence, the operations of the respective units from the sheet feeding unit 1 to the inspection unit 5 are the same as the above-mentioned operations in the simplex printing. In the cutter unit 6, the cutting operation is not carried out, and the sheet is conveyed to the drying unit 8 as the continuous sheet. After drying the ink on the front face by the drying unit 8, the sheet is guided to the path on the side of the reverse unit 9 (the second path) instead of the path on the side of the discharge conveyance unit 10 (the third path). On the second path, the sheet is rolled up by the winding rotary member of the reverse unit 9 that rotates in a forward direction (in the drawing, a counterclockwise direction). In the print unit 4, when the planed front face prints are all ended, the rear end of the print area of the continuous sheet is cut by the cutter unit 6. While the cut position is set as the reference, the continuous sheet on the downstream side in the conveying direction (the printed side) passes through the drying unit 8 and is rolled up by the reverse unit 9 up to the sheet trailing end (cut position). On the other hand, at the same time as this rolling-up, the continuous sheet remaining on the upstream side in the conveying direction with respect to the cut position (on the side of the print unit 4) is rewound to the sheet feeding unit 1 so that the sheet leading end (cut position) does not remain in the decurl unit 2, and the sheet is rolled up to the roll R1 or R2. By this rewinding, the collision with the sheet fed again in the following rear face print sequence is avoided.

After the above-mentioned front face print sequence, the sequence is switched to the rear face print sequence. The winding rotary member of the reverse unit 9 rotates in a direction reverse to the direction at the time of the rolling up (in the drawing, the clockwise direction). The end part of the wound sheet (the sheet trailing end at the time of the rolling-up becomes the sheet leading end at the time of the feeding-out) is fed into the decurl unit 2 along the path represented by the broken line in the drawing. In the decurl unit 2, the correction on the curl applied by the winding rotary member is carried out. In other words, the decurl unit 2 is provided between the sheet feeding unit 1 and the print unit 4 in the first path and also between the reverse unit 9 and the print unit 4 in the second path and becomes a common unit functioning as the decurl in any of the paths. The sheet whose front and rear sides are reversed passes through the skew correction unit 3 and is fed to the print unit 4 where the print of the unit image and the cut mark on the rear face of the sheet is carried out. The printed sheet passes through the inspection unit 5 and is cut at a predetermined unit length which is set in advance in the cutter unit 6. As the print is carried out on both the sides of the cut sheet has, the recording is not performed by the information recording unit 7. The cut sheet is conveyed one by one to the drying unit 8 and passes through the discharge conveyance unit 10 to be sequentially discharged into the discharge unit 12 of the sorter unit 11 and stacked.

In this manner, in the duplex printing, the sheet passes through the first path, the second path, the first path, and the third path in the stated order to be processed. To elaborate, in the duplex printing mode, under the control of the control unit 13, the following sequence of (1) to (11) is executed:

(1) the sheet is fed out from the sheet feeding unit 1 to be fed to the print unit 4;
(2) the print of the unit image is repeatedly performed by the print unit 4 on the first surface of the fed sheet;
(3) the sheet where the print is performed on the first surface is caused to pass through the drying unit 8;
(4) the sheet passing through the drying unit 8 is guided to the second path and rolled up by the winding rotary member provided to the reverse unit 9;
(5) when the repetitive print on the first surface is ended, the sheet is cut by the cutter unit 6 after the lastly printed unit image;
(6) the sheet is rolled up to the winding rotary member until the end part of the cut sheet passes through the drying unit 8 to reach the winding rotary member. Together with this, the sheet cut and left on the side of the print unit 4 is fed back to the sheet feeding unit 1;
(7) after the rolling-up is ended, the winding rotary member is inverted rotated, and the sheet is fed from the second path to the print unit 4 again;
(8) the print of the unit image and the cut mark is repeatedly performed on the second surface of the sheet fed from the second path in the print unit 4;
(9) the cut of the sheet is repeatedly performed in the cutter unit 6 for each unit image where the print is performed on the second surface;
(10) the cut sheet is caused to pass through the drying unit 8 one by one for each unit image; and
(11) the sheet passing through the drying unit 8 is caused to pass through the third path one by one to be discharged into the discharge unit 12.

As described above, in rear face print in the simplex printing mode and the duplex printing mode, the print of the unit image and also the cut mark are recorded, and on the basis of the detection of the cut mark, the sheet is cut by the cutter unit 6.

Figure 4A:
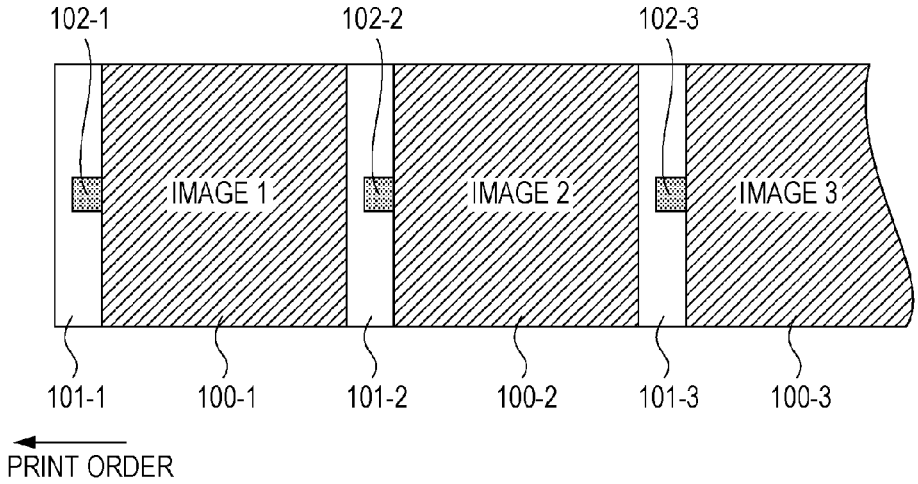
FIGS. 4A to 4C illustrate an arrangement of a plurality of images sequentially printed on a sheet.
Figure 4B:
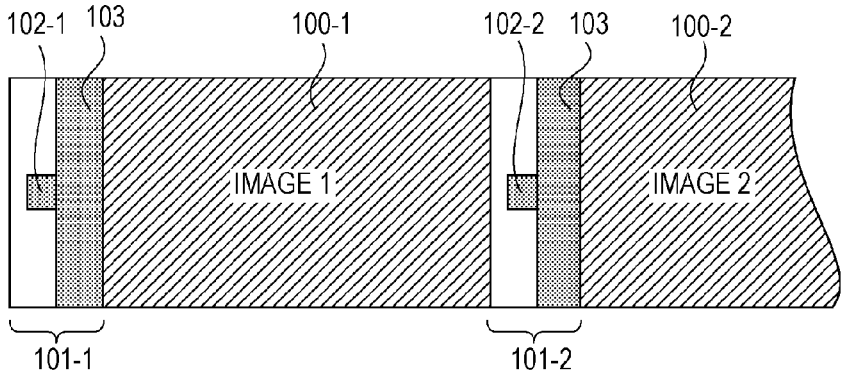
Figure 4C:
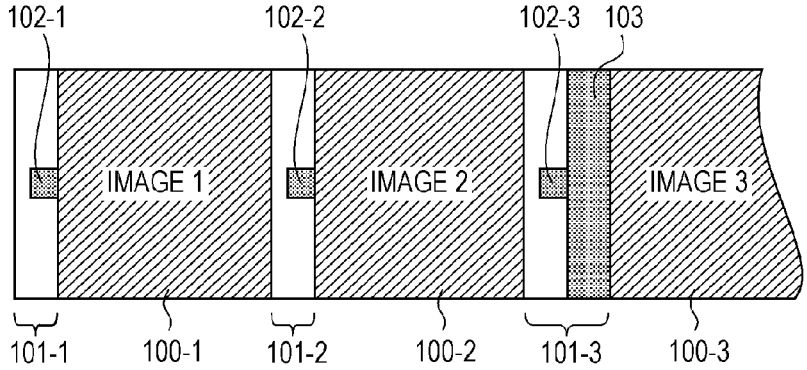

FIGS. 4A to 4C illustrate some examples of arrangements for a plurality of images (an image 1, an image 2, an image 3, . . . ) sequentially printed on the sheet. In FIG. 4A, image areas 100 (100-1, 100-2, 100-3, . . . ) and margin areas 101 (101-1, 101-2, 101-3, . . . ) which are non-image areas are alternately disposed. In the respective margin areas 101, cut marks 102 (102-1, 102-2, 102-3, . . . ) are formed. FIG. 4B illustrates an arrangement example in which an inspection pattern 103 for a maintenance for the print head is provided in the margin area 101 together with the cut mark 102. As will be described below, the inspection pattern 103 is a pattern for non-ejection detection which is formed by a plurality of nozzles and read and analyzed by the inspection unit 5 to determine a state of the print head. The respective margin areas 101 (101-1, 101-2, 101-3, . . . ) are areas obtained by combining the areas where the cut marks 102 (102-1, 102-2, 102-3, . . . ) are formed with the areas where the inspection pattern 103 are formed. In this example, the size of the unit image (the image 1, the image 2, . . . ) in the conveying direction is larger than that of FIG. 4A. FIG. 4C illustrates an arrangement example in which the inspection pattern 103 for the maintenance for the print head is formed only in a part of the margin areas. In other words, the cut mark is more frequently formed in the margin area than the inspection pattern. The margin areas (101-1, 101-2) including the inspection pattern 103 and the margin area (103-3) including no inspection pattern have different sizes of the margin areas in the conveying direction.

Figure 5:
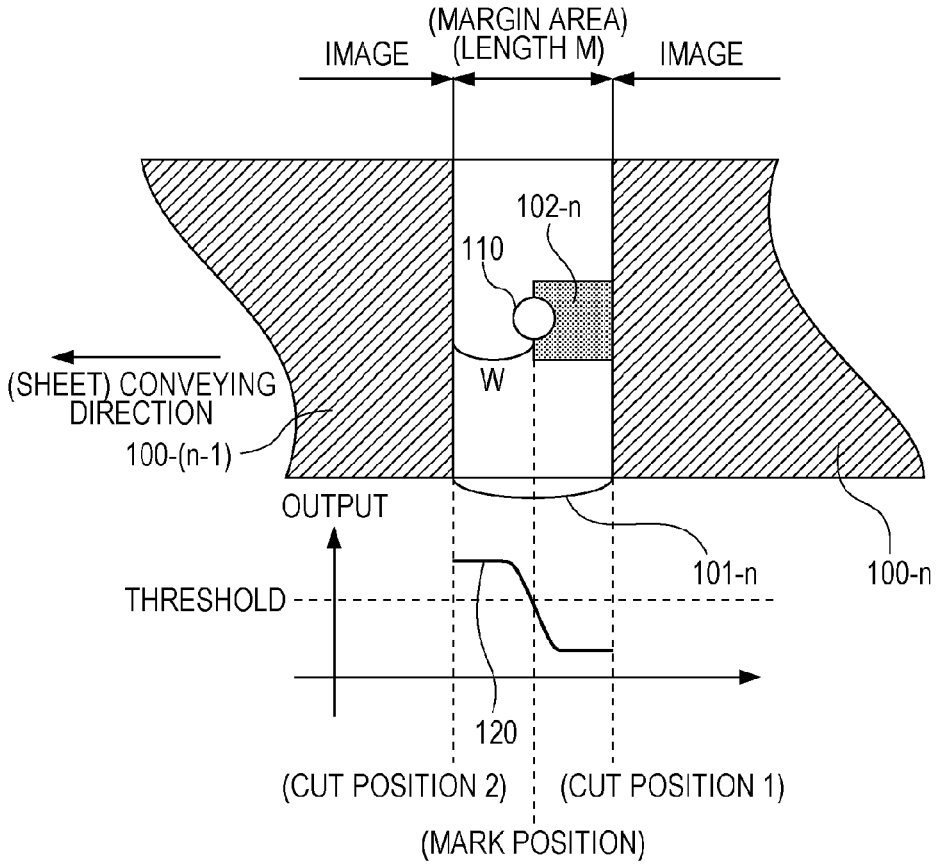
FIG. 5 illustrates a state in which a cut mark is detected.

FIG. 5 illustrates a state in which the cut mark is detected by the cut mark sensor 19. The cut mark sensor 19 is a small-sized optical sensor having a light source and a photo detector. For example, the cut mark 102 is a rectangular mark of 2×2 [mm], and a spot size of an illumination light 110 for illuminating the cut mark is set as ϕ1 [mm]. For the light source, a small-sized semiconductor light source (such as a LED, an OLED, or a semiconductor laser) is suitable. For example, the light source is a red LED, and the cut mark 102 is recorded in block ink which has a satisfactory absorption light intensity distribution characteristic to red. In the sheet conveying direction, the margin area 101 has a width of a predetermined length M (4 mm). Also, in order to easily distinguish the image area 100 from the cut mark 102, a space (while area) having a length half of the length M (2 [mm]) is formed between the previous image area 100-(n−1) and the cut mark 102-*n*. It is however noted that the above-mentioned spaces may not be provided.

A graph on a lower part of FIG. 5 illustrates a change in the detection output of the photo detector of the cut mark sensor 19. Along with the movement of the sheet, the margin area 101 passes through the spot of the illumination light of the sensor (detection position). At this time, a signal level of the detection output drastically changes from high (a white part for high reflectivity) to low (a black part for low reflectivity) as illustrated in a graph 120. The degree of the change (inclination of the graph) is decided by the spot size of the illumination light 110. A position corresponding to a timing at which the changing signal level is below a predetermined threshold set in advance is detected as a mark position. Then, on the basis of the detection mark position, sheet cut positions by the cutter (a cut position 1 and a cut position 2 on the sheet) are set at two positions before and the after the mark position. In the sheet conveying direction, an interval between the cut position 1 and the cut position 2 is equal to the length M of the margin area 101 or slightly larger than the length M.

The detection of the cut mark by the cut mark sensor 19 is not constantly performed during the print operation, and a detection period is set which the margin area of the sheet is estimated to pass through the detection position of the cut mark sensor 19. The mark sensor 19 reads the cut mark only in this detection period. The estimation is carried out through a calculation on the basis of a sheet conveyance distance from the print head that records the cut mark to the mark sensor 19 and the layout of the image so that the detection period can be obtained. According to this, the cut mark sensor 19 does not read the original print image, and therefore a situation is avoided in which the print image is misidentified as the cut mark.

Herein, if the displacement of the print image occurs, the position of the margin area (image layout) is changed from the original position. Also, a distance from the print head 14 to the cut mark sensor 19 (sheet conveyance distance) may be changed because of a mechanical mounting tolerance when the print head 14 is replaced. In view of the above, to improve the estimation accuracy by mitigating these influences, the inspection unit 5 detects the image or the margin area, and on the basis of the detection, the detection period of the cut mark sensor 19 may be set. If the estimation accuracy is improved, even when the width of the margin area (sheet conveyance direction) is narrowed, the cut mark can be reliably captured by the cut mark sensor 19. Thus, the sheet scrap of the margin area, that is, the generation amount of litter and the waste of the sheets can be reduced.

Figure 6:
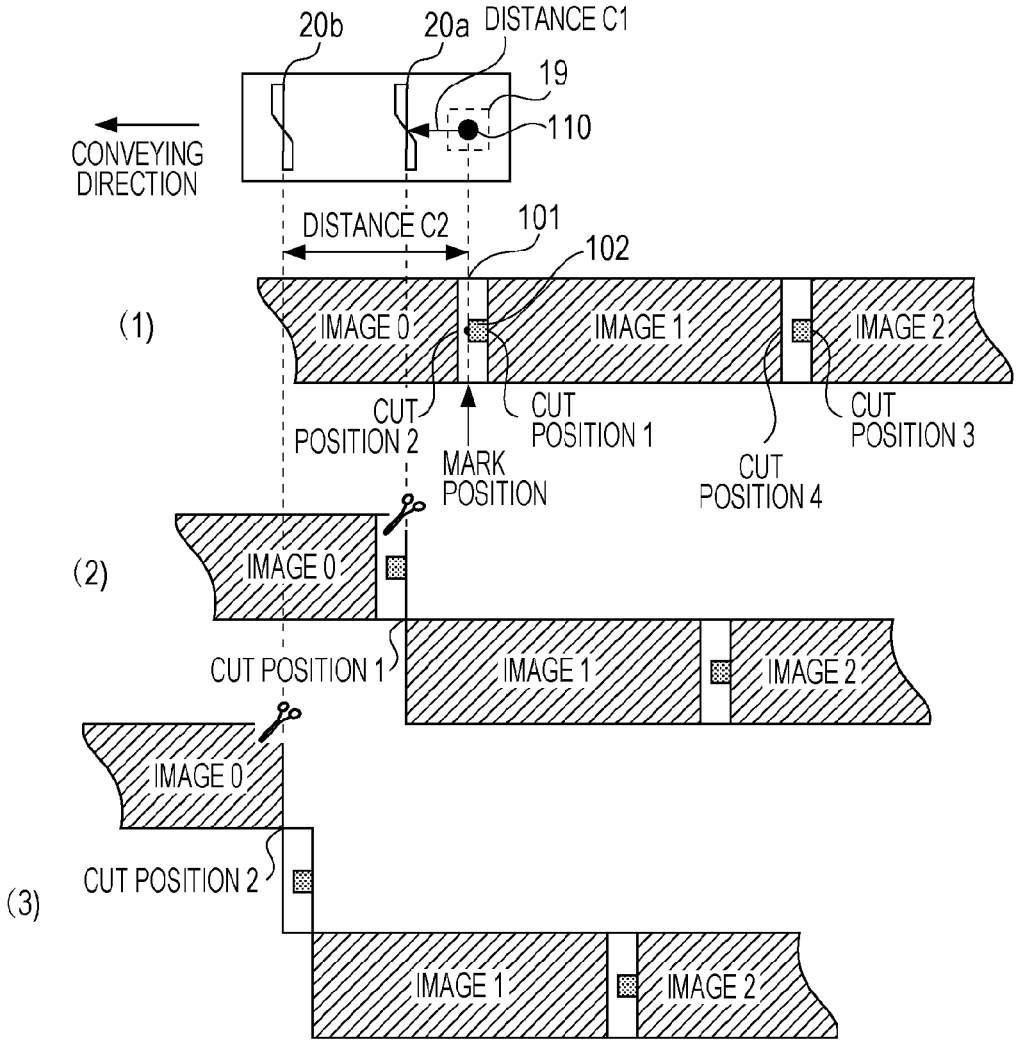
FIG. 6 is an explanatory diagram for describing an operation of detecting the cut mark to cut the sheet.

FIG. 6 is an explanatory diagram for describing an operation of cutting the sheet when the cut mark is detected by the cut mark sensor 19. When the cut mark 102 is detected, the mark position is decided. Before and after this mark position (upstream and downstream), the first cut position (the cut position 1) and the second cut position (the cut position 2) are set. The first cut position is set on the upstream side than the second cut position with respect to the direction in which the sheet is conveyed during the print (state of FIG. 7 (1)). In other words, the first cut position is a position set in accordance with the end part on the upstream side of the margin area, and the second cut position is a position set in accordance with the end part on the downstream side of the margin area.

A distance relation is established in which when the sheet is conveyed after the cut mark is detected, first, the first cut position on the sheet passes through the cut position of the first cutter 20*a*, and subsequently, the second cut position on the sheet passes through the cut position of the second cutter 20*b*. The spot of the illumination light 110 is the detection position of the cut mark sensor 19. A position on the downstream side from this position by a distance C1 is the cut position of the first cutter 20*a*, and a position on the downstream side from this position by a distance C2 (C2>C1) is the cut position of the second cutter 20*b*. By setting the interval between the cut position 1 and the cut position 2 (which is equal to the length M of the margin area 101 or slightly larger than the length M) to be smaller than a difference between the distance C2 and the distance C1, the above-mentioned distance relation is realized. While the sheet is conveyed, first, the first cut position is cut by the first cutter 20*a* (state of FIG. 7 (2)). Subsequently, the second cut position is cut by the second cutter 20*b* (state of FIG. 7 (3)).

Herein, a description will be provided of the meaning that the cut at the first cut position on the upstream side precedes the cut at the second cut position on the downstream side. When the sheet is cut by the cutter 20, the sheet is temporarily stopped along with the sheet cutting operation, and therefore an impact thereof is transmitted to the sheet upstream side, which may affect the mark reading accuracy in the inspection unit 5 or the print accuracy in the print unit 4 in some cases. By performing the cut at the first cut position on the upstream side (the first cutter 20*a*) in advance, the influence occurs only once. This is because at the time of the following cut at the second cut position (the second cutter 20*b*), the sheet to be cut is already separated from the sheet on the upstream side, and the force is not transmitted. If the second cut position is cut ahead of the first cut position, the above-mentioned influence occurs twice, and the influence on the inspection and the print becomes large. If one cutter 20 is used and two continuous cuts are performed by the same cutter, the influence occurs on the upstream of the sheet twice all the same. Therefore, it is beneficial to provide two cutters so that the upstream side is cut first in the two sheet cuts.

Next, a description will be provided of a processing procedure for an analysis for reading and inspecting the inspection pattern formed in the margin area shown in FIG. 4B or FIG. 4C by the inspection unit 5. With regard to the inspection pattern, in the margin area shown in FIG. 4B or FIG. 4C, the inspection pattern is formed in ink of one color in one margin area, or the inspection pattern is formed in ink of a plurality of colors in one margin area. By using a plurality of margin areas, the ink is ejected from all the nozzles of the printer heads of all the colors to form the inspection pattern. In the inspection unit 5, this inspection pattern is read and analyzed to determine whether the state of the nozzle of the print head 14 is normal or not normal (abnormal). As described above, the image sensor of the inspection unit 5 is arranged to respond to the plurality of colors used in the inspection pattern, in this instance, the seven ink colors.

Figure 7:
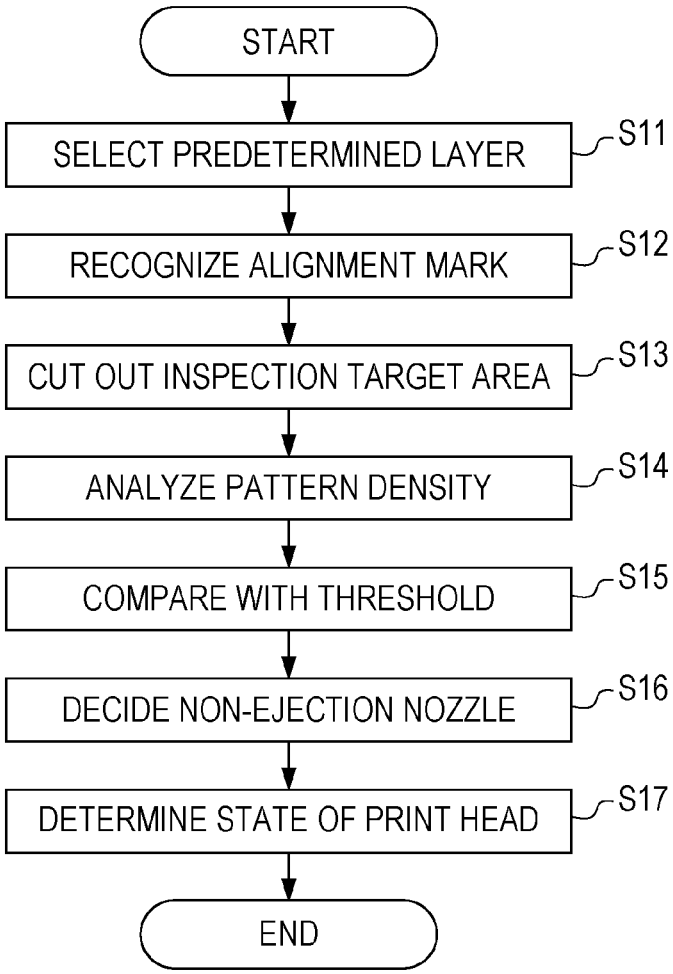
FIG. 7 is a flow chart of a processing procedure for an inspection pattern analysis.
Figure 8:
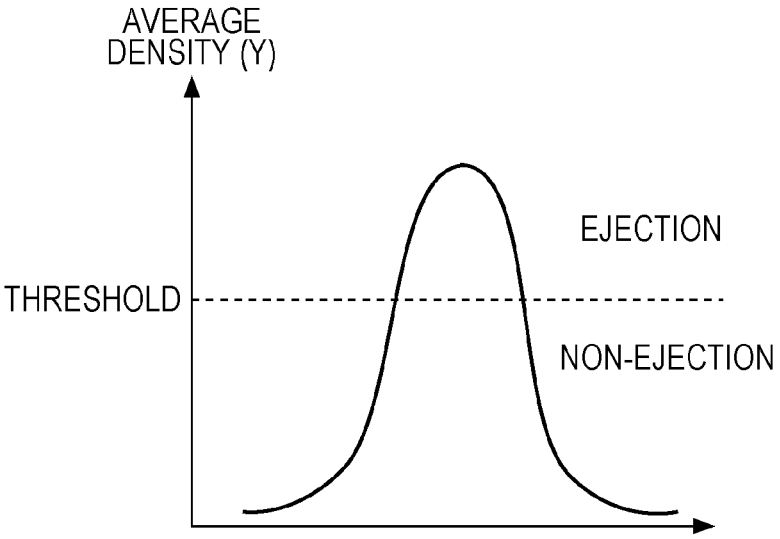
FIG. 8 is an explanatory diagram for describing a determination on ejection or non-ejection.

FIG. 7 is a flow chart of a processing procedure of the inspection pattern analysis. The following processing is performed by a processing unit built in the inspection unit 5 or the control unit 13 of the print apparatus. In step S11, an RGB layer corresponding to print colors is selected. In step S12, an alignment mark included in the inspection pattern is recognized. In step S13, an inspection target area is cut out on the basis of a position of the recognized alignment mark. In step S14, a density of a pattern of the inspection target area is analyzed. In step S15, the density obtained in step S14 is averaged in the X direction to obtain the maximum value to be compared with a threshold. In step S16, while following a comparison result in step S15, a non-ejection nozzle is decided. As illustrated in FIG. 8, when the average density is above the threshold, it is determined as ejection, and when the average density is below the threshold, it is determined as non-ejection (the non-ejection nozzle). In step S17, it is determined whether the state of the print head is normal or abnormal. By counting the number of the non-ejection nozzles of the respective print heads, it is continuously monitored whether the number exceeds a previously set a permissible value or not. When the number doe not exceed the permissible value, it is determined that the print head is normal, and when the number exceeds the permissible value, it is determined that the print head is not normal (abnormal). The permissible value is decided on the basis of print conditions such as the number of nozzles of the print head and coloring materials. Causes in a case where the print head becomes abnormal includes a trouble of the print head 14 (the non-ejection due to the clogging of the nozzle, a malfunction of the head itself such as the element or the disconnection), an ink supply shortage to the print head 14 due to the running of the ink or a trouble of the ink supply system, and the like.

Figure 9:
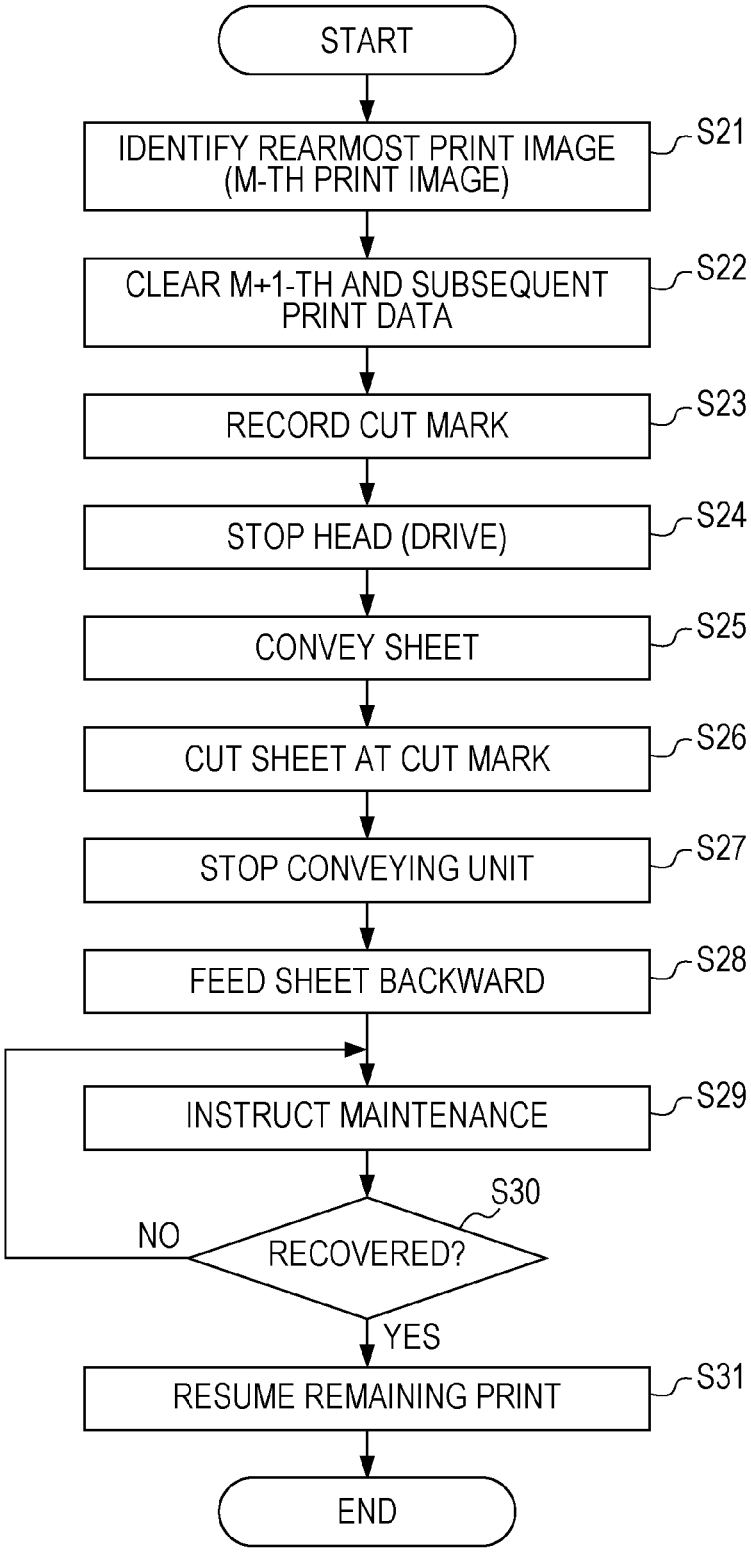
FIG. 9 is a flow chart of a processing sequence in a case where an abnormality of a print head is detected.

FIG. 9 is a flow chart of a processing sequence in a case where the abnormality of the print head is detected through the analysis on the inspection pattern. The following processing is performed by the control unit 13 of the print apparatus. Herein, it is assumed that an abnormality is detected during the print on the first surface in the simplex printing mode or during the print on the second surface in the rear face print in the duplex printing mode. As described above, in these modes, the inspection pattern is formed in all the margin areas as illustrated in FIG. 4B or the inspection pattern is formed in a part of the margin areas as illustrated in FIG. 4C. It is noted that the cut mark is formed in all the margin areas.

When the abnormality of the print head is detected, the sequence is started. In step S21, the currently printed image at the trailing end (M-th) is identified. In step S22, (M+1)-th and subsequent print data is cleared. In step S23, the print of the M-th image which is not cleared in step S22 and is left in the print buffer is completed. Furthermore, after that, the cut mark for cutting the sheet after the M-th image is recorded. The recording of this cut mark is a point in the present sequence.

In step S24, the drive of the print head is stopped. In step S25, even after the head drive is stopped, the sheet conveyance is continued. In step S26, each time the cut mark is detected, the cut of the sheet is repeatedly performed. The cut mark recorded after the M-th image at the trailing end is the last cut mark, and this cut becomes the last. In step S27, after the sheet cut at the last cut mark, the sheet conveyance is stopped. In step S28, the continuous sheet cut by the cutter 20 and left on the upstream side is fed back to be rolled up by the sheet feeding unit 1 (in the case of the simplex printing mode) or the reverse unit 9 (in the case of the rear face print in the duplex printing mode). At the same time, the already cut sheet cut by the cutter 20 and left on the downstream side has been subjected to the print, and thus, the information recording unit 7 and the drying unit 8 apply the processing on the sheet one by one to be discharged into the discharge unit 12.

In this manner, when the abnormality of the print head is detected, the cut mark is recorded after the currently printed image, and it is therefore possible to certainly cut the sheet at the appropriate position. It is noted that with regard to the M-th image, the abnormality is generated in the mid-course of the print, and the image quality in the latter half of the image may be unsatisfactory. In view of the above, the (M−1)-th and preceding images are output as non-defective products, and the M-th image may be discarded as a defective product. In this case, in step S22, the print data including the print data on the M-th image is all clear, and in step S23, the print of the M-th image may not be completed and interrupted in the mid-course, and only the cut mark may be recorded. The M-th uncompleted image part is cut off by the cutter unit 6 and discharged into the dust bin 17.

In step S29, a possible cause is displayed on a display of the operation unit 15 to instruct the user to perform a maintenance operation for eliminating the abnormality of the print head. The user responding to this executes the maintenance operation such as a cleaning, a non-ejection complementary processing, or a print head replacement to recover the normal state of the print head.

In step S30, it is determined whether the maintenance is completed and the print head is recovered or not. When the print head is recovered, the flow shifts to step S31. In step S31, the remaining print is resumed. In the case of the simplex printing mode, the sheet is fed out from the sheet feeding unit 1 again to be fed to the print unit 4, and the print is resumed sequentially from the (M+1)-th (or M-th) image. In the case of the rear face print in the duplex printing mode, the sheet is fed out from the reverse unit 9 again to be fed to the print unit 4, and the print is resumed sequentially from the (M+1)-th (or M-th) image. When all the prints are completed, the sequence is ended.

On the other hand, in a case where the abnormality is detected during the print on the first surface in the front face print in the duplex printing mode, the following processing sequence is executed. In the front face print, the cut mark is not recorded for each margin area. Only the inspection pattern is formed in all or a part of the margin areas. During the front face print, when the abnormality of the print head is detected, the print of the (M+1)-th (or M-th) and subsequent images on the first surface is cancelled, and the cut mark is recorded. This cut mark is detected by the cut mark sensor 19 and the cut is performed by the cutter 20. Then, the continuous sheet where the print is performed on the first surface on the downstream side of the cut position is rolled up by the reverse unit 9, and also the continuous sheet on the upstream side of the cut position is fed back to the sheet feeding unit 1 to be rolled up. After this, when the user completes the maintenance, the remaining print is resumed. The image on the second surface corresponding to the image where the print is normally performed on the first surface and which is rolled up by the reverse unit 9 is identified, and the print on the second surface is sequentially resumed from the identified image. When all the prints are completed, the sequence is ended.

It should be noted that the cut mark may also be detected by utilizing the inspection unit 5 instead of the cut mark sensor 19. Alternatively, by using both the cut mark sensor 19 and the inspection unit 5, the cut mark may also be detected. In either mode, the sensor that detects the cut mark is provided on the downstream of the print position and also on the upstream of the cut position by the cutter.

Causes in a case where the detection inability may occur when the cut mark is to be detected include, for example, the following possibilities.

(1) Case where the Cut Mark is not Normally Printed:

Due to running out of the ink in the print head 14 or temporary clogging of the nozzle, for example, a case exists in which a record failure of the cut mark is caused. Also, due to a partial scratch or dirt on the sheet surface, a case exists in which the record failure of the cut mark is caused.

(2) Case of a Trouble of the Sensor Itself:

A case exists in which the sensor receives electric or optical noise and has disconnection to cause a detection failure. Also, a case exists in which an aging degradation of the light source or the photoreceiver causes the detection failure.

The above-mentioned cases (1) and (2) can be distinguished by using both the cut mark sensor 19 and the inspection unit 5. The cut mark in the margin area is first read and detected by the inspection unit 5, and subsequently, the same cut mark is detected by the cut mark sensor 19. If the cut mark is detected by both the inspection unit 5 and the cut mark sensor 19, this state is the normal state. On the other hand, if the cut mark cannot be detected by both the inspection unit 5 and the cut mark sensor 19, it is determined that the cut mark is not normally printed. In a case where the cut mark is detected by the inspection unit 5 but the cut mark cannot be detected by the cut mark sensor 19, it is determined that the trouble of the cut mark sensor 19 is caused. On the other hand, in a case where the cut mark cannot be detected by the inspection unit 5 but the cut mark can be detected by the cut mark sensor 19, it is determined that the trouble of the inspection unit 5 is caused. In this manner, the same cut mark is detected by two sensors in a time-series manner, and on the basis of detection states of these two sensors, a cause for a case in which the cut mark cannot be detected is determined.

In the print apparatus according to the present embodiment, an arrangement relation is established in which the inspection unit 5 (the first reading unit), the cut mark sensor 19 (the second reading unit), and the cutter 20 are disposed in the order on the downstream of the print unit 4. A rationality for adopting such an arrangement relation will be described below.

Figure 10:
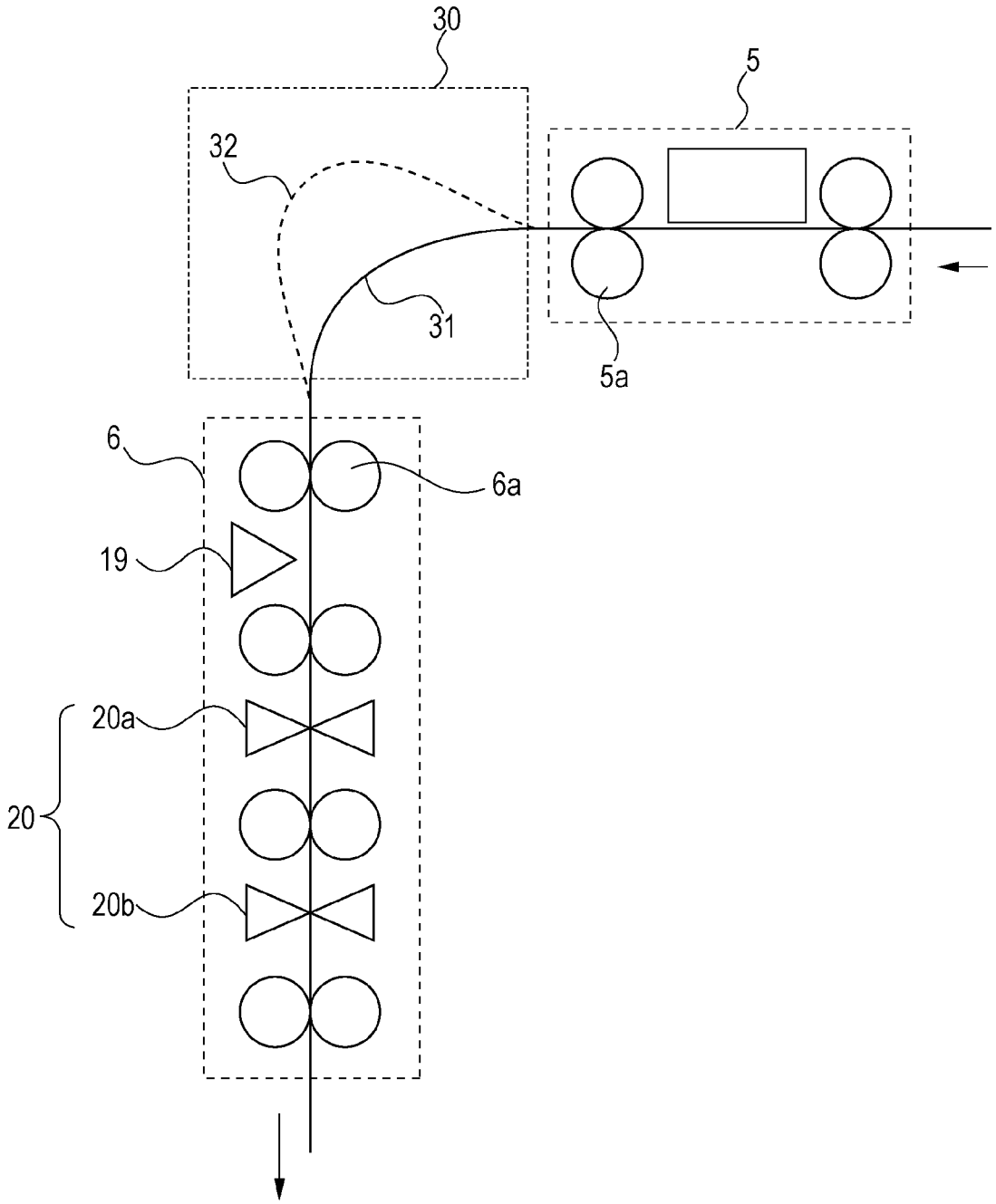
FIG. 10 is an explanatory diagram for describing a rationality of an apparatus layout.

FIG. 10 is an enlarged view of a positional relation among the inspection unit 5, the cutter unit 6, and the sheet conveyance path therebetween. The sheet in conveyance passes through the inspection unit 5 and changes the travelling direction in a space 30 to be introduced into the cutter unit 6. In the space 30, the sheet travels in a path like a state 31 in design. During a period in which the cutter 20 of the cutter unit 6 cuts the sheet, all the conveying rollers of the cutter unit 6 (rollers before and after the cutter 20) temporarily stop the rotation. During that period, the conveying rollers of the inspection unit 5 keep rotating, and the sheet is kept to be fed from the upstream side. For that reason, in the space 30, the sheet has a loop like a state 32 (swell in an outer side direction). When the cutter 20 finishes the cut, the conveying rollers of the cutter unit 6 resume the rotation, and the sheet is fed out to the downstream at a speed faster than a normal speed. For this reason, the loop of the sheet in the space 30 is gradually dissolved. Then, at a timing when the loop is just dissolved, the conveying rollers of the cutter unit 6 return to the normal speed. When the next sheet cut is performed, the sheet is stopped again in the cutter unit 6, and the loop becomes large. In other words, the size of the loop is constantly changed and is not constant. For that reason, the length of the sheet in the conveyance direction between the inspection unit 5 and the cutter unit 6 is not constant and fluctuates. In this manner, the space 30 is provided between the inspection unit 5 and the cutter unit 6 on the downstream thereof (between a most downstream roller pair 5*a* of the inspection unit 5 and a most upstream roller pair 6*a* of the cutter unit 6) as a loop formation space that permits the loop to be generated in the sheet (maximum size of the loop).

Herein, the cut mark sensor 19 is provided on a downstream with respect to the position where the loop is formed (nip position of the most upstream roller pair 6*a*). For that reason, the cut mark recorded on the sheet can be read without receiving the influence from the enlargement and shrinkage of the loop. It is possible to correctly determine that the position at which the sheet should be cut arrives at the cut position of the cutter 20. Also, as the distance between the cut mark sensor 19 and the cutter 20 is extremely small, the even more accurate determination can be performed. As the cut mark sensor can detect the cut mark from a simple light amount change of the optical sensor, the detection does not take time, and a situation in which the distance between the cut mark sensor 19 and the cutter 20 does not become a problem.

On the other hand, as the inspection processing in the inspection unit 5 has a substantial computation amount along with the image processing, additional computation time may be necessary. For that reason, if a distance between an image pickup position of the inspection unit 5 and the cutter 20 is small, the computation may not be in time while the sheet passes through. As the sheet conveyance speed is faster, this problem is more prominent. In view of the above, according to the present embodiment, the distance of the conveyance path between the inspection unit 5 and the cutter 20 is set as an amount in which the time necessary for the computation in the inspection unit 5 is obtained. From the sheet conveyance speed and the distance between those, a passage time in which the sheet passes through. This passage time is set not to be shorter than the computation time necessary for the inspection unit 5. From a different point of view, by setting the distance between the inspection unit 5 and the cutter 20, the sheet conveyance speed and print speed can be improved. Then, the space 30 for forming the loop and the cut mark sensor 19 are arranged in the space between the inspection unit 5 and the cutter 20 generated herein, and the space is effectively utilized to also realize the miniaturization of the print apparatus.

From the above-mentioned rational reasons, the arrangement relation is adopted in which the inspection unit 5 (the first reading unit), the cut mark sensor 19 (the second reading unit), and the cutter 20 are disposed in the order on the downstream of the print head 14. This configuration is especially beneficial for performing the print at the high speed and also with the high quality and for cutting the sheet one by one at the high positional accuracy to obtain the finished print products. In addition, the miniaturization of the apparatus is also realized.

It is noted that in the duplex printing, the generation of the loop on the near side of the cut position is a behavior caused only on the rear face print on the second surface where the sheet is cut for each unit image. In the front face print on the first surface, the sheet cut is not performed for each image, and the loop is not formed. For that reason, the rotation speed of the conveying rollers of the cutter unit 6 (the conveying rollers before and after the cutter 20) is at a constant speed without stopping during the continuous print on the first surface (including a case where the rotation speed is substantially the constant speed) for the rotation. In contrast to this, during the continuous print on the second surface, the rotation speed of the conveying rollers of the cutter unit 6 (cutter conveyance mechanism for conveying the sheet in the vicinity of the cut position by the cutter 20) is changed each time the cut is performed for each unit image as described above. In other words, in accordance with the reading timing of the cut mark by the cut mark sensor 19, before the cut, in the cutter unit 6, the rotation speed is set as zero to stop the rotation, and after the cut, the rotation is resumed, and the speed is set faster than the normal speed to gradually dissolve the loop. After that, at the timing when the loop is dissolved, the speed is returned to the normal speed. This processing is repeatedly performed each time the unit image is cut.

The cutter conveyance mechanism (conveying rollers of the cutter unit 6) is controlled so that the sheet is conveyed at the constant speed without the stop when a plurality of images are sequentially printed on the first surface of the sheet. Subsequently, when a plurality of images are sequentially printed on the second surface of the sheet, in accordance with the reading timing for the cut mark by the cut mark sensor 19, the cutter conveyance mechanism is controlled so that the sheet is conveyed at an inconstant speed including the stop. In other words, the control method for the cutter conveyance mechanism is switched between the front face print and the rear face print. In this manner, in the duplex printing, it is possible to perform the print at the high speed and also with the high quality and cut the sheet one by one at the high positional accuracy to obtain the finished print products.

While the present invention has been described with reference to exemplary embodiments, it is to be understood that the invention is not limited to the disclosed exemplary embodiments. The scope of the following claims is to be accorded the broadest interpretation so as to encompass, for example, all substantially equivalent modifications, structures, and functions.

This application claims the benefit of Japanese Patent Application No. 2010-042338 filed Feb. 26, 2010, which is hereby incorporated by reference herein in its entirety.

What is claimed is:

1. An apparatus capable of performing duplex printing, the apparatus comprising:

a print unit configured to print on a continuous sheet at a print position in a path where the continuous sheet is fed from a sheet feeding unit;

a decurl unit configured to perform decurling of the continuous sheet;

a first reading unit configured to read at least one of a pattern and an image formed on the continuous sheet by the print unit for inspecting a print state of the print unit, at a first reading position on a downstream of the print position in the path;

a second reading unit, provided separately from the first reading unit, configured to read a cut mark formed on the sheet at a second reading position on a downstream of the first reading position in the path;

a cutter unit that cuts the continuous sheet on a downstream of the second reading position in the path, wherein the cutter unit has a first cutter and a second cutter located downstream of the first cutter; and a reverse unit configured to reverse the sheet which has passed through the cutter, wherein, in the duplex printing, the print unit prints a plurality of images on a first surface of the sheet fed from the sheet feeding unit, the sheet printed on the first surface is led to the reverse unit, the reverse unit feeds the reversed sheet toward the print unit again, the decurl unit performs decurling of the continuous sheet fed from the reverse unit, the print unit prints a plurality of images and a plurality of cut marks on a second surface that is a back of the first surface of the sheet fed from the reverse unit through the decurl unit, and the cutter cuts the sheet printed on the second surface based on a reading of the cut mark on the second surface by the second reading unit, wherein the continuous sheet is cut first by a first cut action using the first cutter at a first cut position on the continuous sheet based on a reading of the cut mark by the second reading unit to produce a cut sheet part, on which the image is printed, from the continuous sheet, and subsequently the cut sheet part is cut by a second cut action using the second cutter at a second cut position on the cut sheet part, wherein the first cut position is a position corresponding to an end part on an upstream side of one margin area and the second cut position is a position corresponding to an end part on a downstream side of the one margin area, wherein the one margin area is cut off by the first and second cut actions, and wherein the decurl unit is positioned on upstream of the first reading unit to perform decurling of the continuous sheet prior to when either one of the first reading unit and the second reading unit performs reading.

2. The apparatus according to claim 1, wherein the reverse unit includes a winding rotary member configured to wind the continuous sheet, wherein, in the duplex printing, the continuous sheet where the plurality of images have been printed on the first surface is temporarily wound around the winding rotary member and, after that, the winding rotary member inversely rotates so that the wound continuous sheet is fed to the print unit again.

3. The apparatus according to claim 1, wherein one margin area is between two adjacent images, the apparatus further comprising a controller configured to control the apparatus such that, wherein, in response to the plurality of images being sequentially printed on the first surface, the pattern is formed in at least the one margin area between adjacent images, and wherein, in response to the plurality of images being sequentially printed on the second surface, the plurality of cut marks are formed in margin areas between adjacent images, and the pattern is formed in the at least one margin area.

4. The apparatus according to claim 3, wherein the controller controls the apparatus such that the duplex printing and a simplex printing can be selectively performed, and, in response to the simplex printing being performed, the plurality of images are sequentially printed on the continuous sheet, the plurality of cut marks are formed in the margin areas between the adjacent images, and the pattern is formed in the at least one margin area.

5. The apparatus according to claim 1, further comprising a controller configured to control the apparatus such that, wherein, in response to determining that the print unit is not normal based on a reading by the first reading unit, the continuous sheet having already printed print is temporarily accommodated in the reverse unit, and, after a maintenance for the print unit is finished, the continuous sheet having already printed print is fed from the reverse unit to the print unit again to resume the print.

6. The apparatus according to claim 1, further comprising a controller configured to control the apparatus such that, wherein, in response to determining that the print unit is not normal based on a reading by the first reading unit, the print unit records an after cut mark, the second reading unit reads the after cut mark to cut the continuous sheet, and a print operation is stopped.

7. The apparatus according to claim 6, wherein the controller controls the apparatus such that the continuous sheet cut after it is determined that the print unit is not normal is fed back to the continuous sheet feeding unit and, after a maintenance for the print unit is finished, the continuous sheet is fed from the sheet feeding unit to the print unit again to resume the print.

8. The apparatus according to claim 1, further comprising a conveyance mechanism configured to convey the continuous sheet in a vicinity of a cut position by the cutter unit, wherein a control method for the conveyance mechanism is switched between the print on the first surface and the print on the second surface.

9. The apparatus according to claim 8, further comprising a controller configured to control the apparatus such that, wherein, in response to the plurality of images being sequentially printed on the first surface, the conveyance mechanism is controlled by the controller to convey the continuous sheet without a stop, and, wherein, in response to the plurality of images being sequentially printed on the second surface, the conveyance mechanism is controlled by the controller to convey the continuous sheet at an inconstant speed including a stop in accordance with a reading timing of the cut mark by the second reading unit.

10. The apparatus according to claim 1, further comprising a controller configured to control the second reading unit to read the cut mark during a predetermined detection period, wherein the predetermined detection period is limited to an estimation period in which the margin area, where the cut mark is formed, is calculated to pass through the second reading position.

11. The apparatus according to claim 10, wherein the controller controls the apparatus such that the predetermined detection period is calculated and set based on a reading of the continuous sheet by the first reading unit.

12. The apparatus according to claim 1, further comprising a controller configured to control the apparatus such that a same cut mark is configured to be detected by the first reading unit and the second reading unit, and, in response to at least one of the first reading unit and the second reading unit not detecting the same cut mark, a cause of the not detecting is determined based on detections of the first reading unit and the second reading unit.

13. The apparatus according to claim 1, wherein the print unit includes a plurality of line-type inkjet heads corresponding to a plurality of colors, and the pattern is a pattern for a non-ejection detection which is formed by the plurality of print heads.

14. The apparatus according to claim 1, wherein the first reading unit includes an image sensor of one of a line type and an area type which is capable of reading a range that covers a width of a used sheet, and the second reading unit includes a second reading unit sensor having a reading area that is narrower than a reading area of the image sensor in a width direction of the continuous sheet.

15. The apparatus according to claim 1, wherein the decurl unit is configured to allow the continuous sheet to swell in an outer side direction to form a loop from a normal shape while continuous conveyance speeds of the first reading unit and the cutter have a first difference and to allow the continuous sheet to gradually dissolve from the loop to return to the normal shape at a timing when sheet conveyance speeds of the first reading unit and the cutter have a second difference that is smaller than the first difference.

16. The apparatus according to claim 15, wherein the decurl unit is configured to change a traveling direction of the continuous sheet as the continuous sheet passes through the decurl unit.

* * * * *